US008390655B2

(12) United States Patent
Yoshiga

(10) Patent No.: US 8,390,655 B2
(45) Date of Patent: Mar. 5, 2013

(54) ACTIVE MATRIX LIQUID CRYSTAL DISPLAY AND METHOD OF DRIVING THE SAME AND ELECTRONIC DEVICE

(75) Inventor: Masahiro Yoshiga, Hyogo (JP)

(73) Assignee: Chimei Innolux Corporation, Miao-Li County (TW)

( * ) Notice: Subject to any disclaimer, the term of this patent is extended or adjusted under 35 U.S.C. 154(b) by 395 days.

(21) Appl. No.: 12/697,406

(22) Filed: Feb. 1, 2010

(65) Prior Publication Data

US 2010/0214326 A1 Aug. 26, 2010

(30) Foreign Application Priority Data

Feb. 20, 2009 (JP) ..... 2009-038369

(51) Int. Cl.
*G09G 5/10* (2006.01)

(52) U.S. Cl. ..... 345/690

(58) Field of Classification Search ..... 345/690; 349/39, 48, 142–144
See application file for complete search history.

(56) References Cited

U.S. PATENT DOCUMENTS 5,668,650 A * 9/1997 Mori et al. ..... 349/42
7,903,068 B2 * 3/2011 Chen et al. ..... 345/95
2001/0030699 A1 * 10/2001 Sakuragi ..... 348/302
2003/0206144 A1 * 11/2003 Yudasaka ..... 345/55
2004/0252966 A1 * 12/2004 Holloway et al. ..... 386/46
2008/0158745 A1 * 7/2008 Chen et al. ..... 361/56
2009/0195719 A1 * 8/2009 Kim et al. ..... 349/39

FOREIGN PATENT DOCUMENTS

JP 9006289 1/1997

OTHER PUBLICATIONS

English abstract of JP9006289, pub. Jan. 10, 1997.

* cited by examiner

*Primary Examiner* — William Boddie
*Assistant Examiner* — Towfiq Elahi
(74) *Attorney, Agent, or Firm* — McClure, Qualey & Rodack, LLP

(57) ABSTRACT

An active matrix liquid crystal display device and driving method thereof is provided, in which two different gamma voltage signals can be generated for two pixels of a sub-pixel without extra source lines or gate lines. In a sub-pixel having a first pixel and a second pixel, the switching on/off of the first pixel is controlled by one gate line and that of the second pixel is controlled by one gate line and one source line. The first pixel has a first thin film transistor (TFT) and an electrostatic capacitor. The second pixel has second and third TFTs serially connected. Gate electrodes of the two serially-connected TFTs are connected to the gate line and the source line, respectively.

6 Claims, 6 Drawing Sheets

ACTIVE MATRIX LIQUID CRYSTAL DISPLAY AND METHOD OF DRIVING THE SAME AND ELECTRONIC DEVICE

CROSS REFERENCE TO RELATED APPLICATIONS

This Application claims priority of Japanese Patent Application No. 2009-038369, filed on Feb. 20, 2009, the entirety of which is incorporated by reference herein.

BACKGROUND OF THE INVENTION

1. Field of the Invention

The invention relates to an active matrix liquid crystal display device, and more particularly to an active matrix liquid crystal display device and a driving method thereof for increasing a visual angle.

2. Description of the Related Art

An active matrix liquid crystal display device is a liquid crystal display device controlling light transmittance of liquid crystal material to display images.

FIG. 4 shows a schematic illustrating an active matrix liquid crystal display device. The active matrix liquid crystal display device comprises a liquid crystal display panel 1 with a plurality of pixels disposed in a matrix for displaying images, a gate driver 2 and a source driver 3 both for controlling the driving of the liquid crystal display panel 1, and a signal processing circuit 4 for receiving an image signal to be displayed and outputting the control signals and display data to the gate driver 2 and the source driver 3.

A plurality of pixel electrodes 40 are disposed in a matrix in rows and columns. A scan signal line 41 (or named a gate line) is used to select the pixels disposed in the same row according to control of the gate driver 2. A data signal line 42 (or named a drain line) is used to provide the voltages corresponding to data to be displayed to the pixels disposed in the same column according to control of the source driver 3. A switching on/off device 43 is used to provide the data of the data signal line 42 to a pixel of a liquid crystal unit according to the scan signal, which may be a thin film transistor (TFT). An opposite electrode 44 is used to provide a common voltage for each liquid crystal unit. A liquid crystal unit coupled between the pixel electrode 40 and the opposite electrode 44 is referred to as a pixel.

The liquid crystal unit uses the voltages applied to the pixel electrode 40 and the opposite electrode 44 to achieve a shutter function for adjusting light quantity. The pixels are regularly divided into the RGB, and a color image composed of RGB lights is projected when a color filter of the RGB is disposed near to the opposite electrode 44. A part corresponding to the RGB pixel array is referred to as a sub-pixel.

By applying a voltage signal to each sub-pixel, the brightness corresponding to the applied voltage is displayed. FIG. 5 and FIG. 6 show the gamma curve diagrams between the voltage of the voltage signal and the brightness. The curve indicates a gamma curve which is obtained by viewing the display in front of the liquid crystal panel. However, the brightness of the pixel for the liquid crystal display depends on the visual angle. So, a gamma curve which is obtained by watching the liquid crystal panel from a side angle is different than an ideal gamma curve in reality, thus displaying an obscure image for a viewer.

Therefore, the method shown in FIG. 5 and FIG. 6 is used to divide each sub-pixel into two parts which separately provide two different voltage signals according to the curve b and curve c, such that the average brightness obtained by viewing the liquid crystal panel from a side angle may form the ideal gamma curve a, thus reducing dependence on the visual angle. Other than the situations shown in FIG. 5 and FIG. 6, the two signals may be the combinations of other signals.

However, if each sub-pixel is divided into two parts to provide two different voltage signals, respectively, the source and gate lines must be increased, thus causing decrease in aperture rate for the liquid crystal panel.

BRIEF SUMMARY OF THE INVENTION

An active matrix liquid crystal display device and the driving method thereof, in which two different gamma voltage signals can be generated for two pixels of a sub-pixel without extra source or gate lines, are provided, thereby increasing a visual angle without decreasing aperture rate for the liquid crystal panel.

An exemplary embodiment of an active matrix liquid crystal display device for converting an input data into a new data by generating two different gamma signals in a sub-pixel to obtain a target gamma signal is provided according to the invention. Each sub-pixel comprises a first pixel, a second pixel, a first thin film transistor coupled between the first pixel and a source line having a gate coupled to a gate line, an electrostatic capacitor coupled between the first pixel and the gate line, and a second thin film transistor and a third thin film transistor connected in series, coupled between the second pixel and a signal line. A gate of the second thin film transistor is coupled to the gate line and a gate of the third thin film transistor is coupled to the source line. The first pixel is controlled to switch on/off by the gate line and the second pixel is controlled to switch on/off by the gate line and the source line, thereby generating the two different gamma signals for the first pixel and the second pixel.

In the active matrix liquid crystal display device of the invention, the signal line is a common line.

In the active matrix liquid crystal display device of the invention, one of the two different gamma signals is a black signal or a white signal, and the other different gamma signal is a gray signal.

In the active matrix liquid crystal display device of the invention, the electrostatic capacitor is used to adjust a drain voltage of the first thin film transistor coupled to the first pixel.

An electronic device comprises the active matrix liquid crystal display device according to the invention, wherein the electronic device is a cellular phone, a digital camera, a personal digital assistant (PDA), an automotive displayer, an aviation displayer, a digital photo frame, or a portable DVD displayer.

Furthermore, an exemplary embodiment of a method for driving the active matrix liquid crystal display device according to the invention to obtain a dark color gray scale signal is provided. The gate line is turned on. A voltage of the source line is set to a low voltage level. The voltage of the source line is set from the low voltage level to a high voltage level. A voltage of the signal line is reversed. The voltage of the source line is set from the high voltage level to the low voltage level and a voltage of the second pixel is set to a voltage level that is equal to the reversed voltage of the signal line, so as to obtain a black color display state for the second pixel. The voltage of the source line is set from the low voltage level to the high voltage level and the voltage of the second pixel that has been set is fixed to the voltage level.

Moreover, an exemplary embodiment of a method for driving the active matrix liquid crystal display device according to the invention to obtain a bright color gray scale signal is provided. The gate line is turned on. A voltage of the source line is set to a low voltage level. The voltage of the source line is set from the low voltage level to a high voltage level. A voltage of the signal line is reversed. The voltage of the source line is kept at the high voltage level and a voltage of the second pixel is fixed.

According to the invention, the source line is associated with the gate line to control the switching on/off of a single pixel for a sub-pixel to solve the problems in the prior art.

In the active matrix liquid crystal display device according to the invention, the sub-pixel comprises the first pixel and the second pixel. The switching on/off of the first pixel is controlled by the gate line, and the switching on/off of the second pixel is controlled by the gate line and the source line. The first pixel comprises a thin film transistor and an electrostatic capacitor. The second pixel comprises two thin film transistors connected in series. A gate of one of the two thin film transistors is coupled to the gate line, and a gate of the other thin film transistor is coupled to the source line.

According to the invention, the active matrix liquid crystal display device generates two different gamma voltage signals for two pixels of a sub-pixel without extra source or gate line, thus increasing a visual angle without decreasing the aperture rate for the liquid crystal panel.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
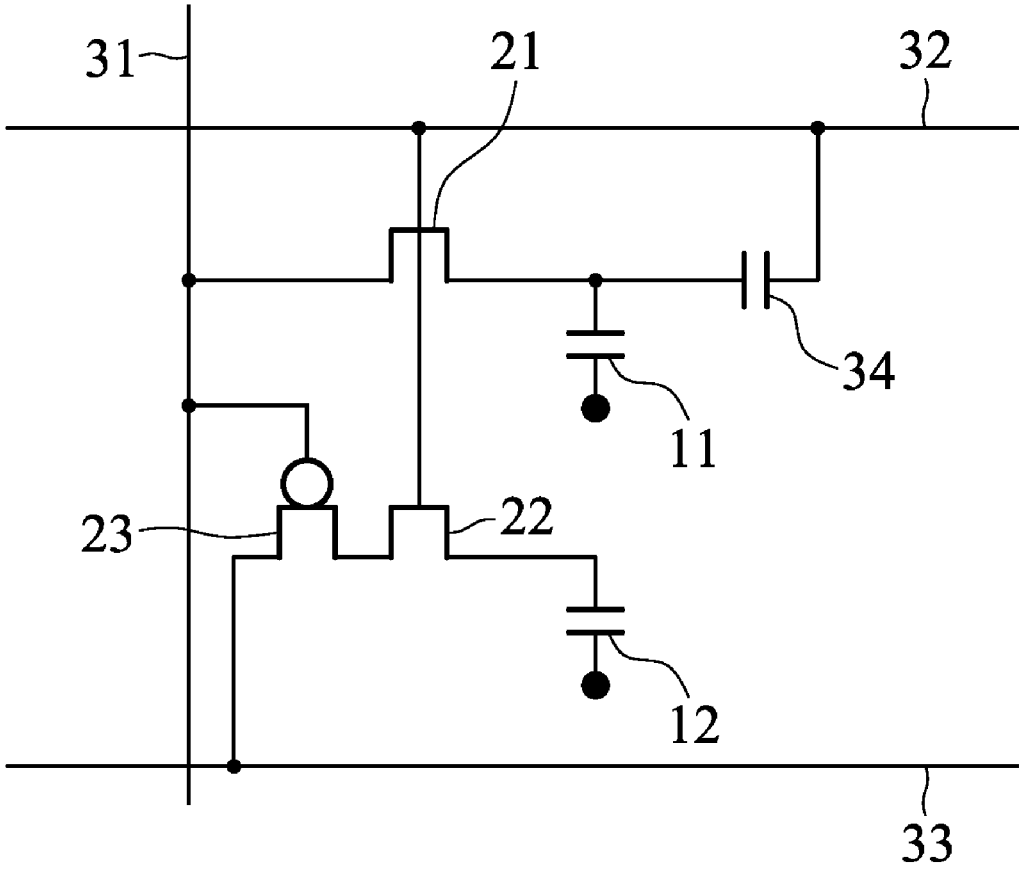
FIG. 1 shows a schematic illustrating a sub-pixel in an active matrix liquid crystal display device according to an embodiment of the invention.

FIG. 1 shows a schematic illustrating a circuit of a sub-pixel in an active matrix liquid crystal display device according to an embodiment of the invention. Each sub-pixel comprises a first pixel 11 coupled to a first thin film transistor (TFT) 21 and a second pixel 12 coupled to a second TFT 22, wherein the first TFT 21 and the second TFT 22 are controlled to switch on/off when a gate line is selected. Each gate of the first TFT 21 and the second TFT 22 is coupled to a gate line 32. The second pixel 12 further comprises a third TFT 23 which has a gate coupled to a source line 31.

When the source line 31 is at a low voltage level, the third TFT 23 of the second pixel 12 is turned on, and then a white color signal or a black color signal is obtain through the second TFT 22 and a common line 33 that functions as a signal line. Although a structure of the first pixel 11 is known in the art, a voltage range of the source line 31 is set to a higher than normal state according to a condition that the third TFT 23 can operate normally. When the gate line 32 is turned off, a voltage of the first pixel 11 is reduced by an electrostatic capacitor 34, so as to obtain a satisfactory pixel voltage. The electrostatic capacitor 34 is used to adjust a drain voltage of the first TFT 21 coupled to the first pixel 11 according to the invention.

Figure 2:
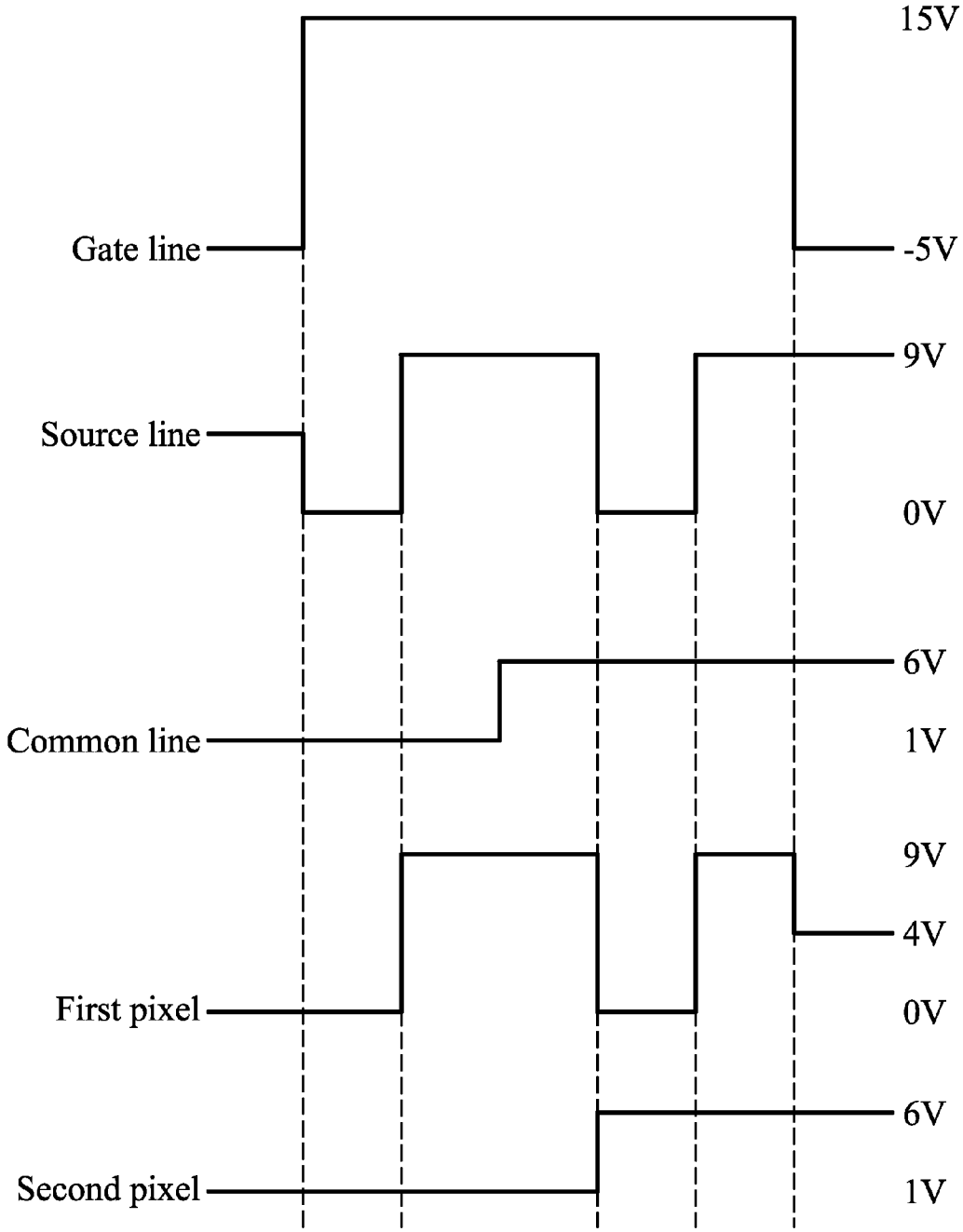
FIG. 2 shows a timing diagram of a method for driving the active matrix liquid crystal display device according to an embodiment of the invention.

FIG. 2 shows a timing diagram of a method for driving the active matrix liquid crystal display device to obtain a dark color (below 50%) gray scale signal according to an embodiment of the invention. Referring to FIG. 1 and FIG. 2 together, the first TFT 21 and the second TFT 22 are turned on when the gate line 32 is turned on by setting a voltage of the gate line 32 to 15V. Next, the third TFT 23 is turned on by setting a voltage of the source line 31 to 0V (i.e. the source line 31 is turned on) such that a voltage of the second pixel 12 is equal to that of the common line 33 (i.e. 1V). Simultaneously, the voltage of the first pixel 11 is equal to that of the source line 31 (i.e. 0V).

By setting the voltage of the source line 31 to 9V, the third TFT 23 is turned off such that the voltage of the second pixel 12 is fixed at 1V, and the voltage of the first pixel 11 is changed to 9V in response to the voltage of the source line 31. Next, the voltage of the common line 33 is reversed from 1V to 6V. Next, the voltage of the source line 31 is set to 0V such that the third TFT 23 is turned on and the voltage of the second pixel 12 is equal to that of the common line 33 (i.e. 6V), thereby obtaining a black color display state for the second pixel 12. Simultaneously, the voltage of the first pixel 11 is changed to 0V in response to the voltage of the source line 31. Therefore, by setting the voltage of the source line 31 to 9V once again, the black color display state is fixed for the second pixel 12.

Finally, by setting the voltage of the gate line 32 to −5V (i.e. the gate line 32 is turned off), the first TFT 21 and the second TFT 22 are turned off, thus the voltage of the second pixel 12 is fixed at 6V. The voltage of the first pixel 11 is changed from 9V to 4V due to coupling effect. Therefore, the dark color gray scale signal is generated in the sub-pixel when the first pixel 11 is operated at a voltage of 4V for a gray color display state and the second pixel 12 is operated at a voltage of 6V for a black color display state.

Figure 3:
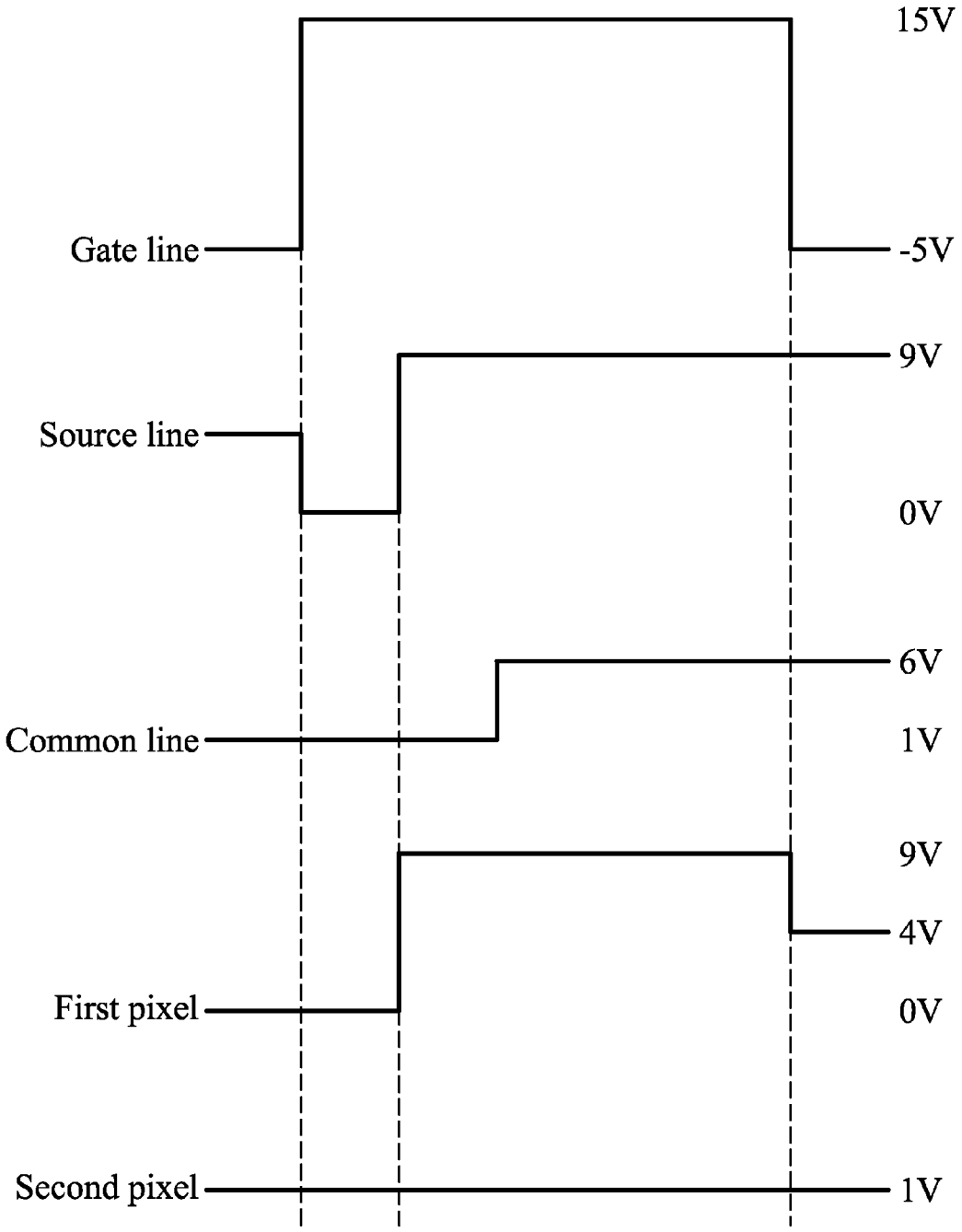
FIG. 3 shows a timing diagram of a method for driving the active matrix liquid crystal display device according to another embodiment of the invention.
Figure 4:
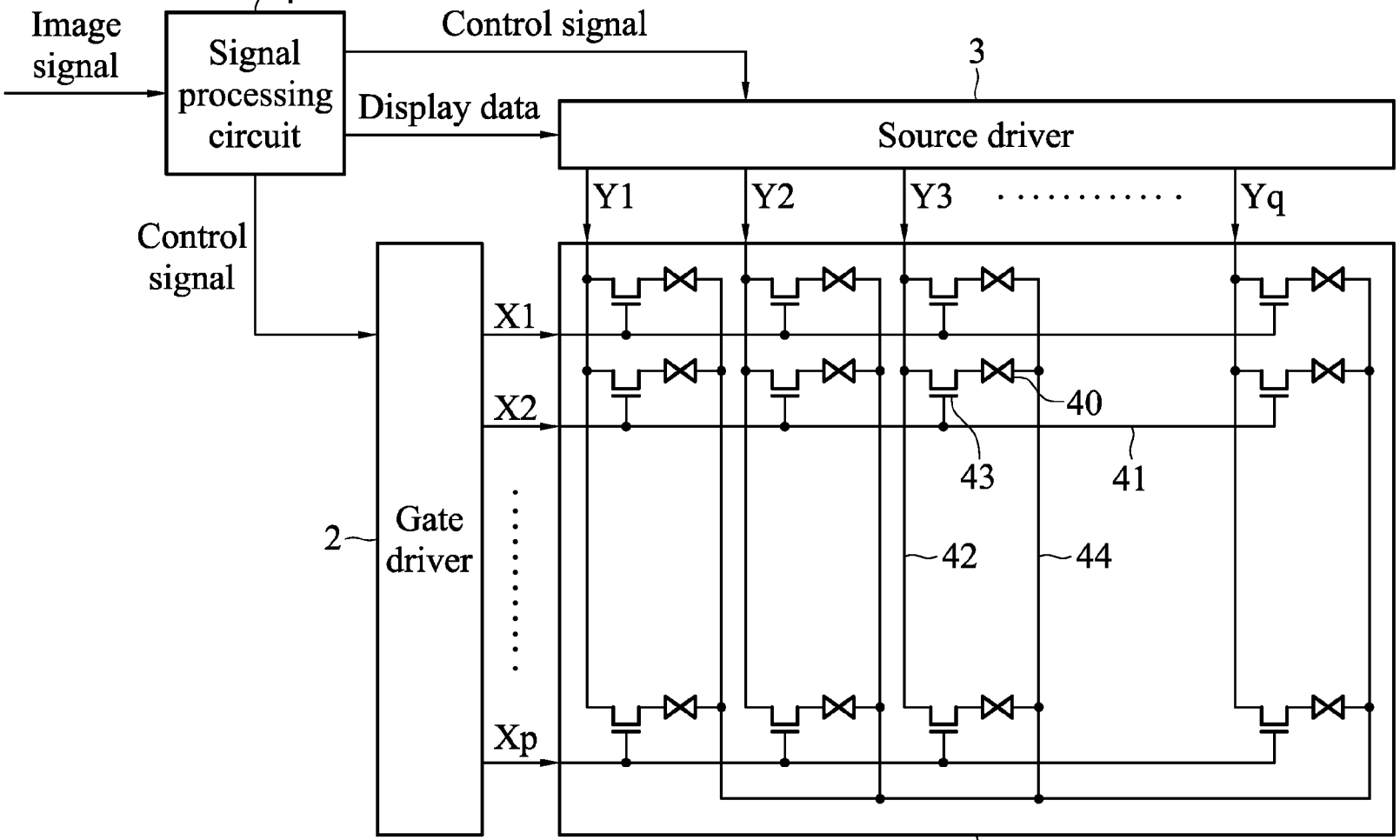
FIG. 4 ( PRIOR ART )
FIG. 4 shows a schematic illustrating an active matrix liquid crystal display device.
Figure 5:
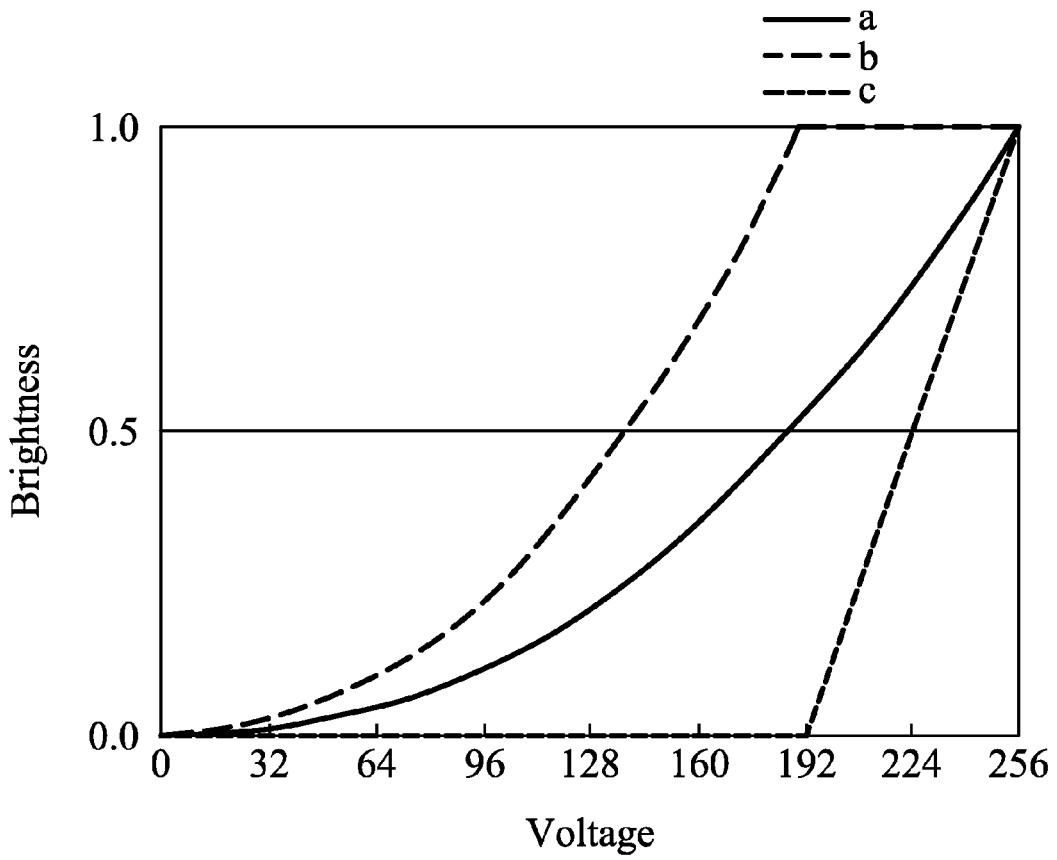
FIG. 5 ( PRIOR ART )
FIG. 5 shows a gamma curve diagram between voltage and brightness.
Figure 6:
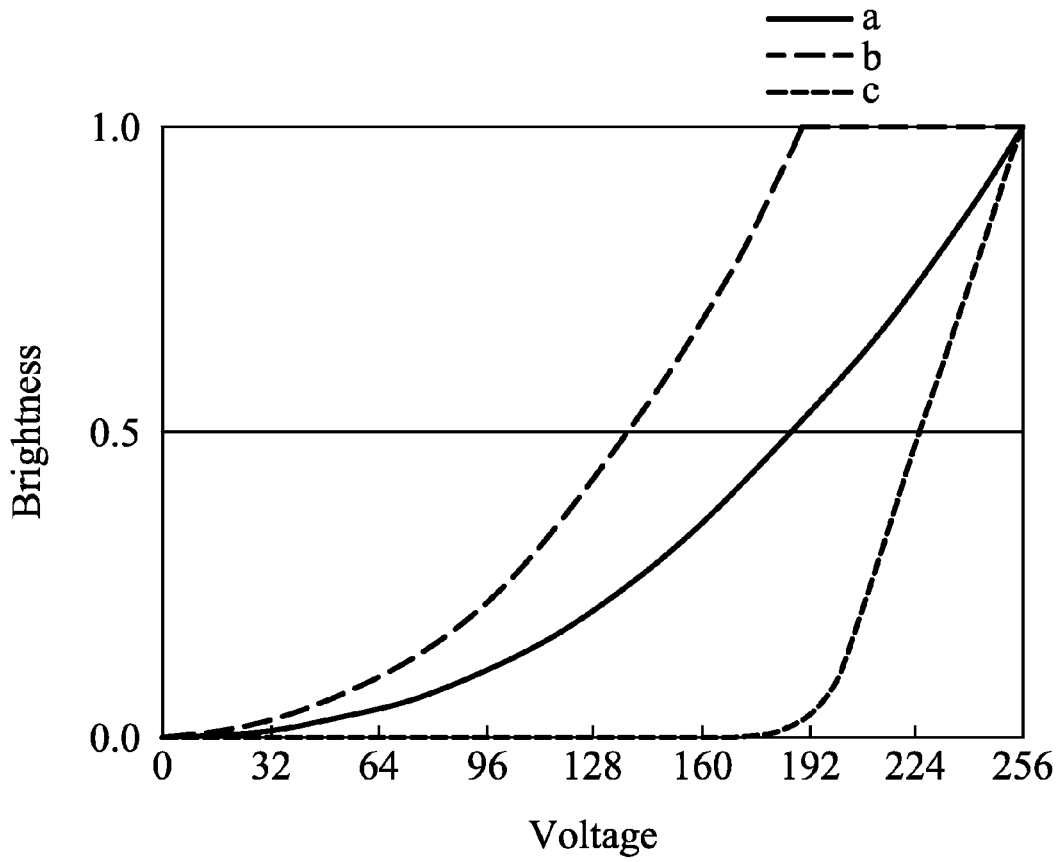
FIG. 6 ( PRIOR ART )
FIG. 6 shows another gamma curve diagram between voltage and brightness.

FIG. 3 shows a timing diagram illustrating a method for driving the active matrix liquid crystal display device to obtain a bright color (above 50%) gray scale signal. Referring to FIG. 1 and FIG. 3 together, the first TFT 21 and the second TFT 22 are turned on when the gate line 32 is turned on by setting the voltage of the gate line 32 to 15V. Next, the third TFT 23 is turned on by setting the voltage of the source line 31 to 0V (i.e. the source line 31 is turned on) such that the voltage of the second pixel 12 is equal to that of the common line 33 (i.e. 1V).

By setting the voltage of the source line 31 to 9V, the third TFT 23 is turned off such that the voltage of the second pixel 12 is fixed at 1V. Next, the voltage of the common line 33 is reversed from 1V to 6V. By keeping the voltage of the source 31 at 9V, a white color display state is fixed for the second pixel 12.

Finally, by setting the voltage of the gate line 32 to −5V (i.e. the gate line 32 is turned off), the first TFT 21 and the second TFT 22 are turned off, thus the voltage of the second pixel 12 is fixed at 1V. The voltage of the first pixel 11 is changed from 9V to 4V due to coupling effect. Therefore, the bright color gray scale signal is generated in the sub-pixel when the first pixel 11 is operated at a voltage of 4V for a gray color display state and the second pixel 12 is operated at a voltage of 1V for a white color display state.

As described above, according to the invention, the circuit and the driving method thereof may obtain two gamma voltages for a sub-pixel without extra source lines or gate lines.

Furthermore, the active matrix liquid crystal display device according to the invention may be implemented in an electronic device, such as a cellular phone, a digital camera, a personal digital assistant (PDA), an automotive displayer, an aviation displayer, a digital photo frame, or a portable DVD displayer.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A method for driving an active matrix liquid crystal display device for converting an input data into a new data by generating two different gamma signals in a sub-pixel to obtain a target gamma signal, to obtain a dark color gray scale signal, wherein each sub-pixel comprises: a first pixel; a second pixel; a first thin film transistor coupled between the first pixel and a source line, having a gate coupled to a gate line; an electrostatic capacitor coupled between the first pixel and the gate line; and a second thin film transistor and a third thin film transistor connected in series, coupled between the second pixel and a signal line, wherein a gate of the second thin film transistor is coupled to the gate line and a gate of the third thin film transistor is coupled to the source line, wherein the first pixel is controlled to switch on/off by the first thin film transistor and the second pixel is controlled to switch on/off by the second thin film transistor and the third thin film transistor, thereby generating the two different gamma signals for the first pixel and the second pixel, the method comprising:

turning on the gate line;

setting a voltage of the source line to a low voltage level;

setting the voltage of the source line from the low voltage level to a high voltage level;

reversing a voltage of the signal line;

setting the voltage of the source line from the high voltage level to the low voltage level and setting a voltage of the second pixel to a voltage level that is equal to the reversed voltage of the signal line, so as to obtain a black color display state for the second pixel; and setting the voltage of the source line from the low voltage level to the high voltage level and fixing the voltage of the second pixel that has been set to the voltage level.

2. The method as claimed in claim 1, wherein the signal line is a common line.

3. The method as claimed in claim 1, wherein one of the two different gamma signals is a black signal or a white signal, and he other different gamma signal is a gray signal.

4. The method as claimed in claim 1, wherein the electrostatic capacitor is coupled to a drain of the first thin film transistor of the first pixel, and is used to adjust a drain voltage of the first thin film transistor.

5. An electronic device using the method as claimed in claim 1, wherein the electronic device is a cellular phone, a digital camera, a personal digital assistant (PDA), an automotive displayer, an aviation displayer, a digital photo frame, or a portable DVD displayer.

6. A method for driving an active matrix liquid crystal display device for converting an input data into a new data by generating two different gamma signals in a sub-pixel to obtain a target gamma signal, to obtain a bright color gray scale signal, wherein each sub-pixel comprises: a first pixel; a second pixel; a first thin film transistor coupled between the first pixel and a source line, having a gate coupled to a gate line; and electrostatic capacitor coupled between the first pixel and the gate line; and a second thin film transistor and a third thin film transistor connected in series, coupled between the second pixel and a signal line, wherein a gate of the second thin film transistor is coupled to the gate line and a gate of the third thin film transistor is coupled to the source line, wherein the first pixel is controlled to switch on/off by the first thin film transistor and the second pixel is controlled to switch on/off by the second thin film transistor and the third thin film transistor, thereby generating the two different gamma signals for the first pixel and the second pixel, the method comprising:

turning on the gate line;

setting a voltage of the source line to a low voltage level;

setting the voltage of the source line from the low voltage level to a high voltage level;

reversing a voltage of the signal line; and keeping the voltage of the source line at the high voltage level and fixing a voltage of the second pixel.

* * * * *